US007029397B1

(12) United States Patent
Barwick

(10) Patent No.: US 7,029,397 B1
(45) Date of Patent: Apr. 18, 2006

(54) NIGHTSTICK WITH HANDCUFF

(76) Inventor: Richard Barwick, 716 W. Edgehill Rd., San Bernardino, CA (US) 92405

( * ) Notice: Subject to any disclaimer, the term of this patent is extended or adjusted under 35 U.S.C. 154(b) by 0 days.

(21) Appl. No.: 10/997,373

(22) Filed: Nov. 24, 2004

(51) Int. Cl.
*A63B 59/00* (2006.01)

(52) U.S. Cl. ..... 463/47.4; 119/801

(58) Field of Classification Search ..... 463/47.2, 463/47.4; 70/15, 16, 17, 18, 19; 119/801, 119/806, 807, 808; 294/19.1, 19.3
See application file for complete search history.

(56) References Cited

U.S. PATENT DOCUMENTS

| | | | | | |
|---|---|---|---|---|---|
| 80,350 | A | * | 7/1868 | Hoffman | 294/104 |
| 116,097 | A | | 6/1871 | Reichard | |
| 365,568 | A | * | 6/1887 | Belz | 119/801 |
| 465,069 | A | | 12/1891 | Reid | |
| 772,468 | A | * | 10/1904 | Maltby | 70/16 |
| 832,143 | A | | 10/1906 | Mercer | |
| 1,102,943 | A | | 7/1914 | Murphy | |
| 1,586,412 | A | * | 5/1926 | Curtis | 70/18 |
| 1,803,280 | A | * | 4/1931 | Elihu et al. | 70/16 |
| 2,949,761 | A | * | 8/1960 | Mitchell et al. | 70/16 |
| 3,621,681 | A | | 11/1971 | Mikesic | |
| 5,320,349 | A | | 6/1994 | Winston | |
| 5,400,623 | A | * | 3/1995 | Bota | 70/16 |
| 5,460,373 | A | * | 10/1995 | McNutt | 463/47.2 |
| 5,482,271 | A | * | 1/1996 | McNutt | 119/808 |
| 5,494,283 | A | | 2/1996 | Harris | |
| 5,555,751 | A | * | 9/1996 | Strickland et al. | 70/16 |
| 5,893,799 | A | * | 4/1999 | Studley et al. | 463/47.2 |
| 6,615,622 | B1 | * | 9/2003 | MacAleese et al. | 70/16 |
| 6,638,172 | B1 | | 10/2003 | Demars | |

* cited by examiner

*Primary Examiner*—William M. Pierce
(74) *Attorney, Agent, or Firm*—Denton L. Anderson; Sheldon & Mak

(57) ABSTRACT

A device useful as a nightstick includes a generally linear long member and an attached short member. The short member can be curved or otherwise disposed so as to define a slot with a single open end. The device includes a handcuff clasp for closing the open end and to thereby define an enclosed portion of the slot between the long member and the short member. The handcuff clasp is moveable between an open position and a closed position. A trigger is provided proximate to the attachment point between the long member and the short member. Power means are also provided for closing the slot by rapidly moving the handcuff clasp to the closed position.

18 Claims, 6 Drawing Sheets

NIGHTSTICK WITH HANDCUFF

FIELD OF THE INVENTION

This invention relates generally to law enforcement equipment and, more specifically, to nightsticks and handcuffs.

BACKGROUND OF THE INVENTION

Subduing a suspected criminal is a tricky and dangerous task for a peace officer. Subduing an individual typically requires placing the individual's wrists in a pair of handcuffs. However, to handcuff an individual, a peace officer must necessarily come into very close proximity to the individual. If the individual then becomes belligerent or otherwise resists the handcuffing process, the proximity of the peace officer to the individual places the peace officer at considerable risk. Both the peace officer and the peace officer's revolver and nightstick are within easy reach of the individual. All too often, the officer's attempt to handcuff the individual turns into a wrestling match between the individual and the officer, placing the officer in deadly peril and often forcing the officer to resort to deadly force.

Also, criminal suspects are quite often cooperative with a peace officer up until the moment when the criminal suspects believes that they are about to be arrested. As soon as the peace officer reaches for his or her handcuffs, many criminal suspects become combative or attempt to flee.

Accordingly, there is a need for better peace officer equipment which will avoid the aforementioned problems.

SUMMARY OF THE INVENTION

The invention satisfies this need. The invention is a device suitable for use as a nightstick. The device comprises (a) a long member, the long member being generally linear and having a proximal end, a distal end and one or more side walls; (b) a short member attached to the long member near the distal end of the long member, the short member and the long member cooperating to define a slot with a single open end, the slot being at least about 2 inches in length; (c) a power-operated handcuff clasp for closing the open end of the slot to thereby define an enclosed portion of the slot having a maximum length of between about 1½ inches and about 6 inches and a maximum width of between about 1½ inches and about 6 inches, the handcuff clasp being moveable between a closed position and an open position; (d) power means for urging the handcuff clasp to the closed position; and (e) a trigger disposed proximate to the proximal end of the short member for activating the power means and to thereby cause the handcuff clasp to rapidly move from the open position to the closed position.

DESCRIPTION OF THE DRAWINGS

These and other features, aspects and advantages of the present invention will become better understood with reference to the following description, appended claims and accompanying drawings where:

DETAILED DESCRIPTION

The following discussion describes in detail one embodiment of the invention and several variations of that embodiment. This discussion should not be construed, however, as limiting the invention to those particular embodiments. Practitioners skilled in the art will recognize numerous other embodiments as well.

The invention is a device 10 useful as a nightstick. The 10 device comprises a long member 12, a short member 14 and a power-operated handcuff clasp 16.

Figures 1, 2:
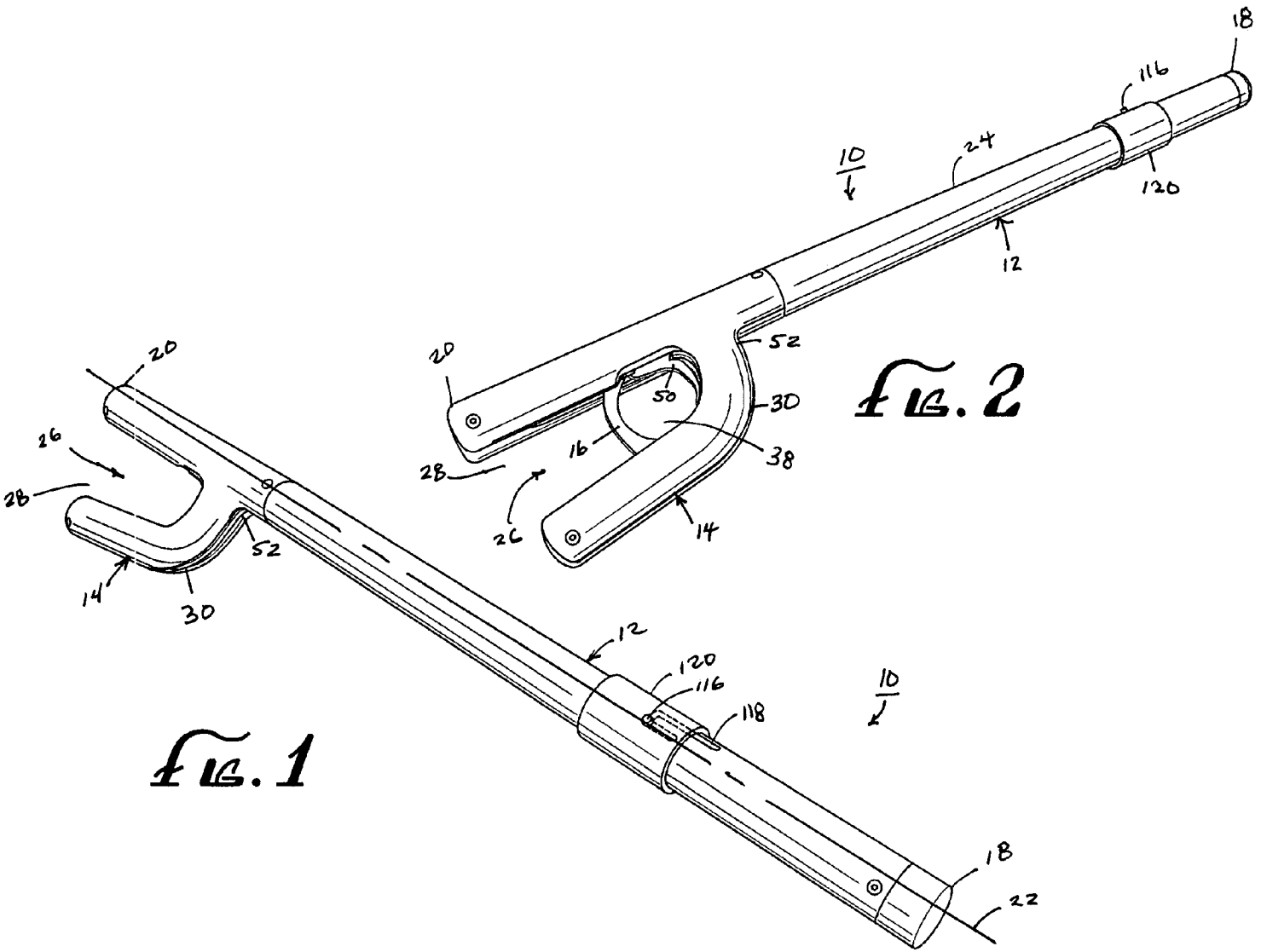
FIG. 1 is a perspective view of a nightstick having features of the invention, showing the handcuff clasp in the retracted position.
FIG. 2 is a second perspective of the nightstick illustrated in FIG. 1, showing the handcuff clasp in the locking position.

The device 10 is illustrated in FIG. 1 showing the handcuff clasp 16 retracted back into the device 10, i.e., in an open position. FIG. 2 illustrates the device 10 with the handcuff clasp 16 shown in a non-retracted, i.e., closed position.

The long member 12 is generally linear and has a proximal end 18, a distal end 20, a longitudinal axis 22 and one or more side walls 24. In the embodiment illustrated in the drawings, the long member 12 has a generally circular cross-section, but other cross-section shapes can be used. The long member 12 is typically at least about 1½ feet long. In one embodiment, the long member 12 is about 27¼ inches long. Where the long member 12 has a circular cross-section, the outside diameter of the long member 12 is typically between about 1¼ inches and about 1½ inches. The long member 12 is typically made from a steel alloy. Other shapes, sizes and materials can also be used.

In one embodiment (not shown), the long member 12 can be constructed in a telescoping fashion, such that it can be collapsed lengthwise to a fraction of its fully extended length.

The short member 14 is attached to the long member 12 near the distal end 20 of the long member 12. Typically, the short member 14 has an identical cross-section to that of the long member 12, but other cross-sections can also be used. In a typical embodiment, the short member 14 is about 8 inches long, although other lengths can also be used. Like the long member 12, the short member 14 is typically made from a steel alloy.

The short member 14 and the long member 12 cooperate to define a slot 26 between them, with a single open end 28. Where the device 10 is to be used as a nightstick, the slot 26 is sized and dimensioned to accept a portion of an arrestee's anatomy, typically a wrist, arm, ankle or leg. The slot 26 is at least about 2 inches in length. In embodiments where the short member 14 is generally linear (not shown), the short member 14 is attached to the long member 12 at an acute angle wherein the acute angle formed by the attachment of the short member 14 to the long member 12. In the embodiment illustrated in the drawings, the short member 14 has an arcuate section 30.

Typically, the open end 28 of the slot 26 is wider than the end opposite the open end 28, but this is not necessary. Slots 26 of generally uniform width are also possible.

As illustrated in FIGS. 3–8 and 14, the handcuff clasp 16 is disposed within the short member 14 when it is in its retracted, closed position. In other embodiments (not shown), the retracted handcuff clasp 16 can alternatively be disposed within the distal end of the long member 12.

Figure 3:
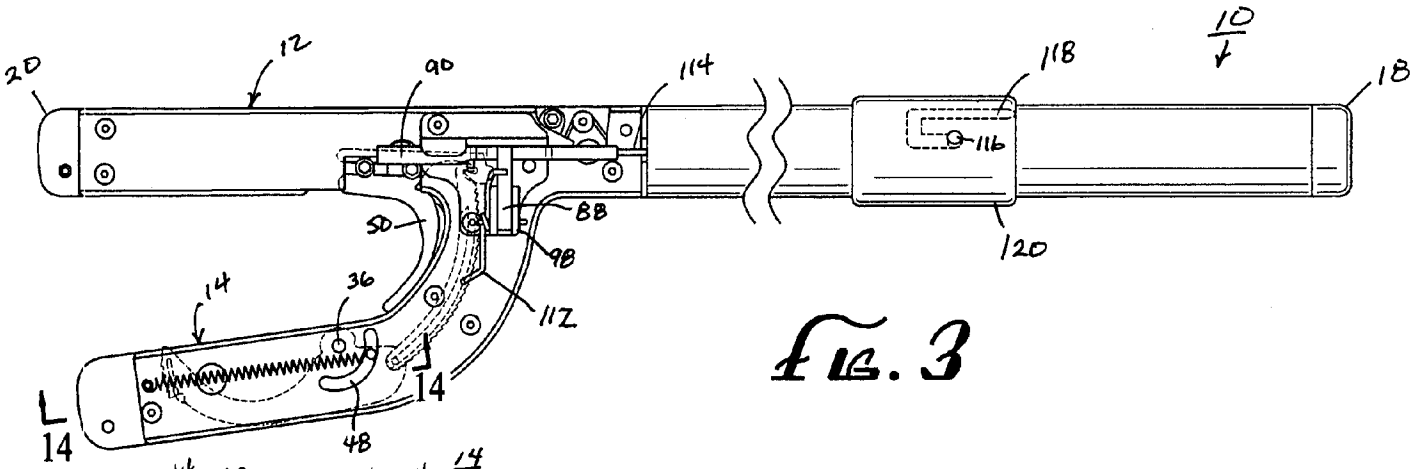
FIG. 3 is a cross-sectional side view of the nightstick illustrated in FIG. 1.
Figure 14:
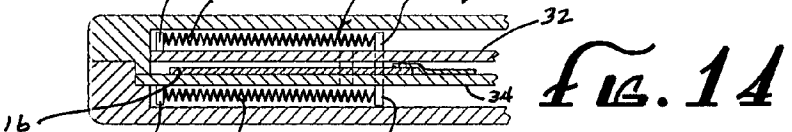
FIG. 14 is a cross-sectional detail view of the short member of the nightstick illustrated in FIG. 3, taken along line 14—14.
Figure 4:
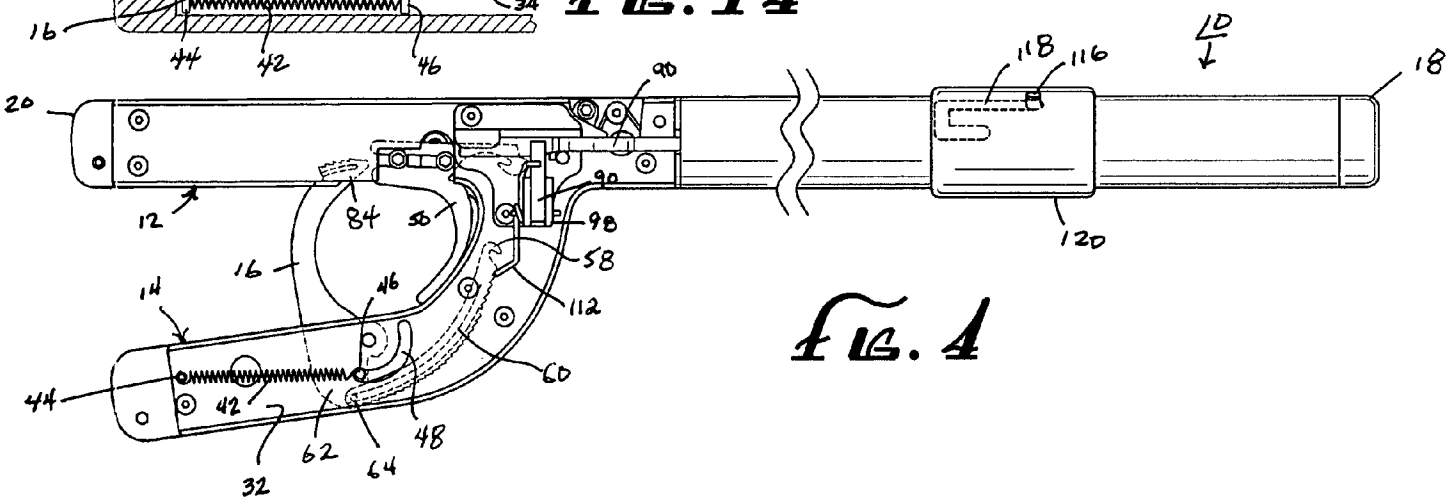
FIG. 4 is a second cross-sectional view of a nightstick illustrated in FIG. 1.
Figure 5:
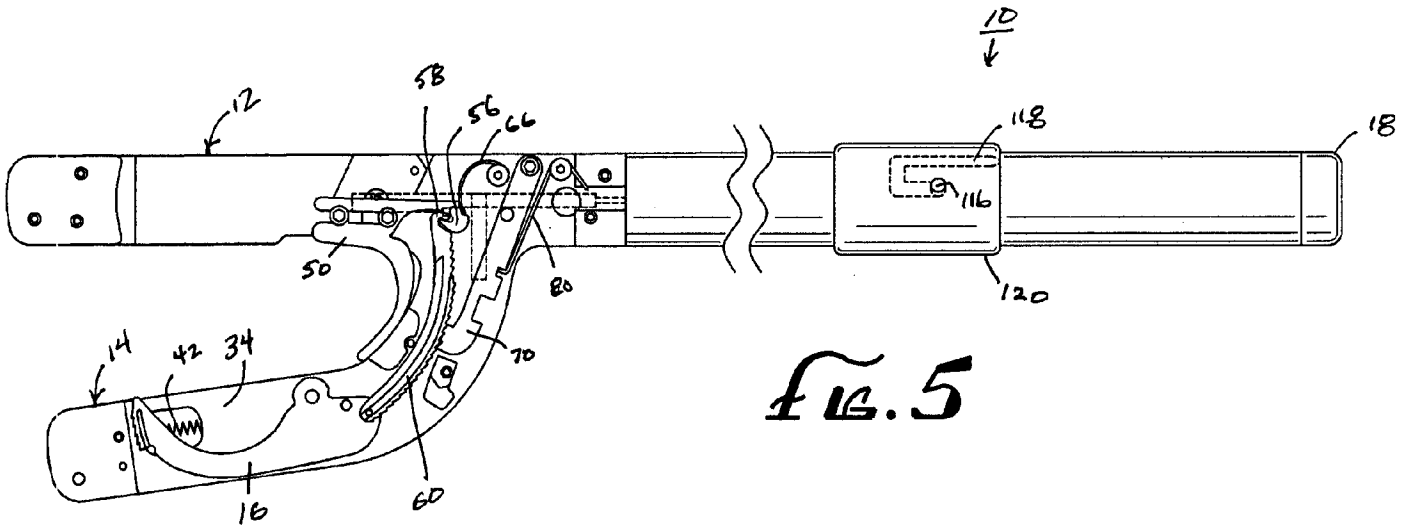
FIG. 5 is a third cross-sectional side view of the nightstick illustrated in FIG. 1.
Figure 6:
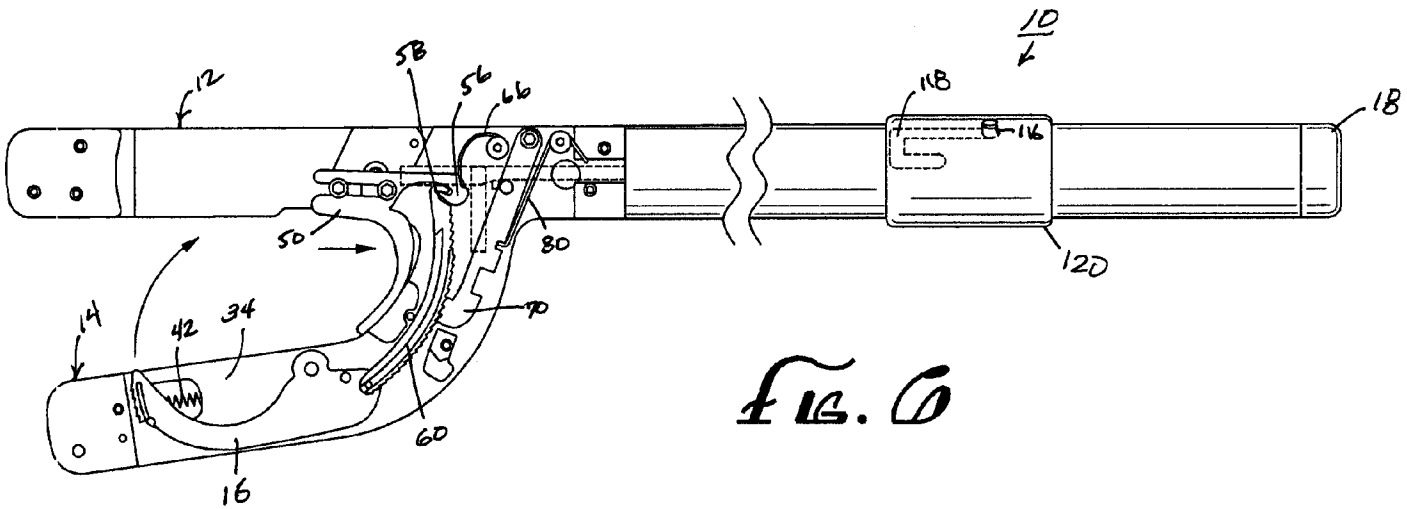
FIG. 6 is a fourth cross-sectional side view of the nightstick illustrated in FIG. 1.
Figure 7:
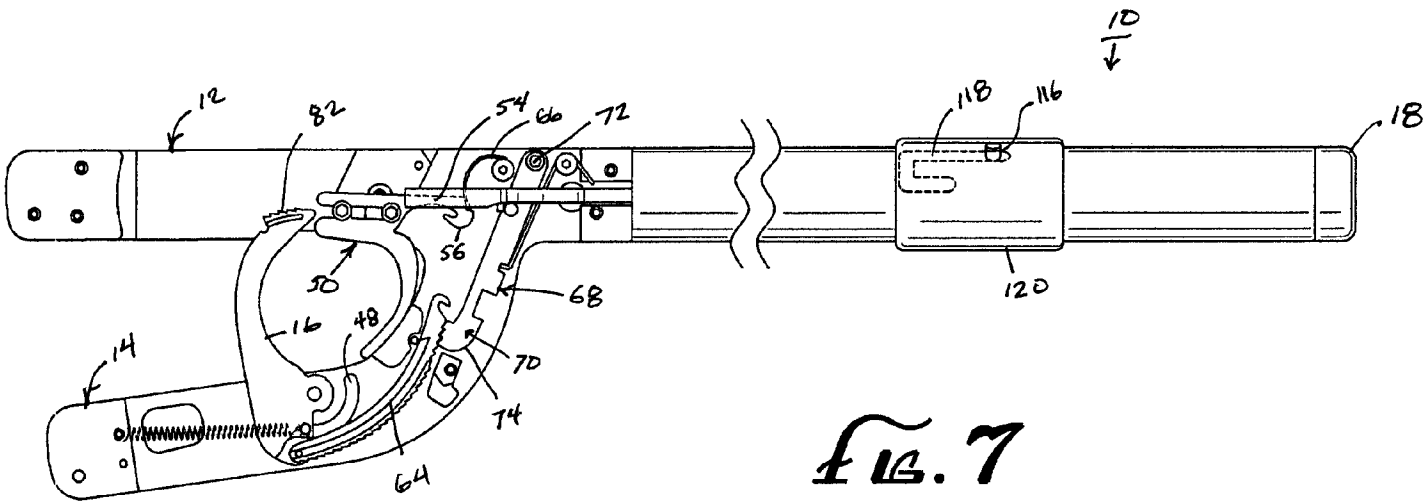
FIG. 7 is a fifth cross-sectional side view of the nightstick illustrated in FIG. 1.
Figure 8:
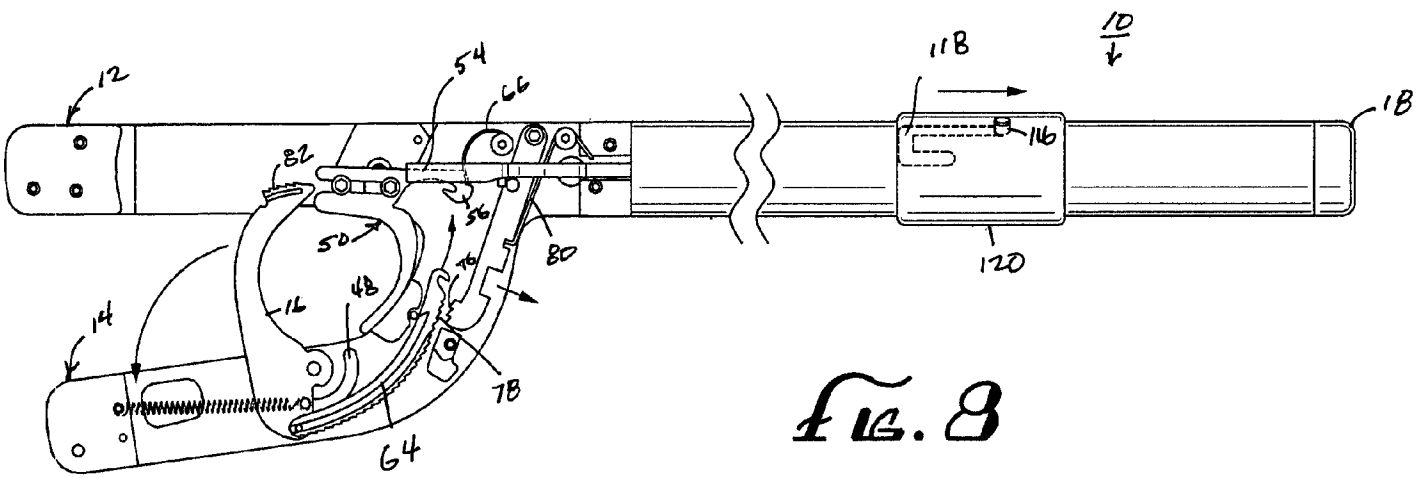
FIG. 8 is a sixth cross-sectional side view of the nightstick illustrated in FIG. 1.

As illustrated in FIG. 14, the handcuff clasp 16 is disposed between a first inner plate 32 and a second inner plate 34. The handcuff clasp 16 is swivelable around a swivel pin 36, such that the handcuff clasp 16 is moveable between the closed position and the open position. FIGS. 3, 5 and 6 illustrate the handcuff clasp 16 retracted into the short member 14 in the retracted, open position. FIGS. 4, 7 and 8 illustrate the handcuff clasp 16 in the extended, closed position.

When the handcuff clasp 16 is in the closed position, an enclosed portion 38 of the slot 26 is defined having a maximum length of between about 1½ inches and about 6 inches and a maximum width of between about 1½ inches and about 6 inches. Where the device 10 is to be used as a nightstick, the enclosed portion 38 is sized and dimensioned to firmly retain a portion of the anatomy of an arrestee, such as a wrist, arm, ankle or leg. In a typical device 10, where the portion of the arrestee's anatomy is a wrist, the enclosed position 38 of the slot 26 typically has a maximum length between about 1½ inches and about 2 inches, and a maximum width between about 1½ inches and about 2 inches.

Preferably, the handcuff clasp 16, when in the closed position, is wholly retained within the slot 26 and does not extend outwardly beyond the slot 26. This feature allows the peace officer, after clasping the handcuff clasp 16 around the wrist or the ankle of an arrestee to thrust the long member 12 downwardly while maintaining the long member 12 in a generally vertical position to pin the arrestee's wrist or ankle to the ground without applying pressure to the handcuff clasp 16.

The device 10 further comprises power means 40 for urging the handcuff clasp 16 to the closed position. In the embodiment illustrated in the drawings, the power means 40 is provided by a pair of coil springs 42, one attached above the first inner plate 32 and one attached below the second inner plate 34. Both coil springs 42 are attached at their distal ends to a fixed post 44 and are attached at their proximal ends to a pair of opposed clasp attachment posts 46 attached to the handcuff clasp 16 and moveable in paths within arcuate slots 48 defined in the first inner plate 32 and the second inner plate 34, respectively.

The device 10 also further comprises a trigger 50 for activating the power means 40 and for thereby causing the handcuff clasp 16 to rapidly move from the open position to the closed position. The trigger 50 is disposed proximate to the proximal end 52 of the short member 14, that is, at the end of the slot 26 furthest away from the open end 28 of the slot 26. In the embodiment illustrated in the drawings, the trigger 50 is slidable in a direction parallel to the longitudinal axis 22 of the long member 12.

The proximal end 54 of the trigger 50 comprises a trigger latch 56 as illustrated in the drawings. The trigger latch 56 is sized and dimensioned to accept and retain the latch tip 58 of a clasp extension member 60 when the trigger 50 is in the ready position, that is, when it is in its left-most position in FIGS. 5 and 6.

The clasp extension member 60 is rotatably attached to the proximal end 62 of the handcuff clasp 16 about a clasp extension member pin 64. When the handcuff clasp 16 is retracted back into the short member 14, the clasp extension member 60 is guided through a passageway within the interior of the proximal end 52 of the short member 14 to the trigger latch 56, whereupon the trigger latch 56 and a latch tip 58 of the clasp extension member 60 can engage one another, so that the handcuff clasp 16 is firmly retained in the open position.

A trigger spring 66 is provided to urge the trigger latch 56 into engagement with the latch tip 58 of the clasp extension member 60, that is, urge the trigger latch 56 to the left in FIGS. 5 and 6.

In the embodiment illustrated in the drawings, the device 10 further comprises a clasp locking mechanism 68. The clasp locking mechanism 68 is optional, depending upon the intended use for the device and the strength of the power means 40. Where the device 10 is to be used as a nightstick, a clasp locking mechanism 68 is generally advantageous.

In the embodiment illustrated in the drawings, the clasp locking mechanism 68 comprises the clasp extension member 60 and a clasp lock 70 which is capable of engaging and retaining the clasp extension member 60. As illustrated in FIGS. 7 and 8, the clasp lock 70 is swively attached within the long member 12 to a clasp lock pin 72. The distal end 74 of the clasp lock 70 is provided with a plurality of teeth 76. The clasp extension member 60 is provided with a corresponding plurality of teeth 78. The teeth 76 on the clasp lock 70 and the teeth 78 on the clasp extension member 60 are capable of engaging and retaining one another as illustrated in FIG. 7. However, the teeth 76 on the clasp lock 70 and the teeth 78 on the clasp extension member 60 are adapted to allow the clasp extension member 60 to slide in a direction away from the clasp lock 70, but to prevent the clasp extension member 60 from moving in a direction towards the clasp lock 70 when the teeth 76 of the clasp lock 70 are engaged within the teeth 78 of the clasp extension member 60. A clasp lock spring 80 is provided to urge the clasp lock 70 in the direction of the clasp extension member 60.

As an alternative or additional method of locking the handcuff clasp 16 in the closed position, an additional clasp lock (not shown) can be retained within the distal end 20 of the long member 12 to operatively engage the distal end 82 of the handcuff clasp 16, such as by engaging handcuff clasp teeth 84 disposed at the distal end 82 of the handcuff clasp 16.

Figure 9:
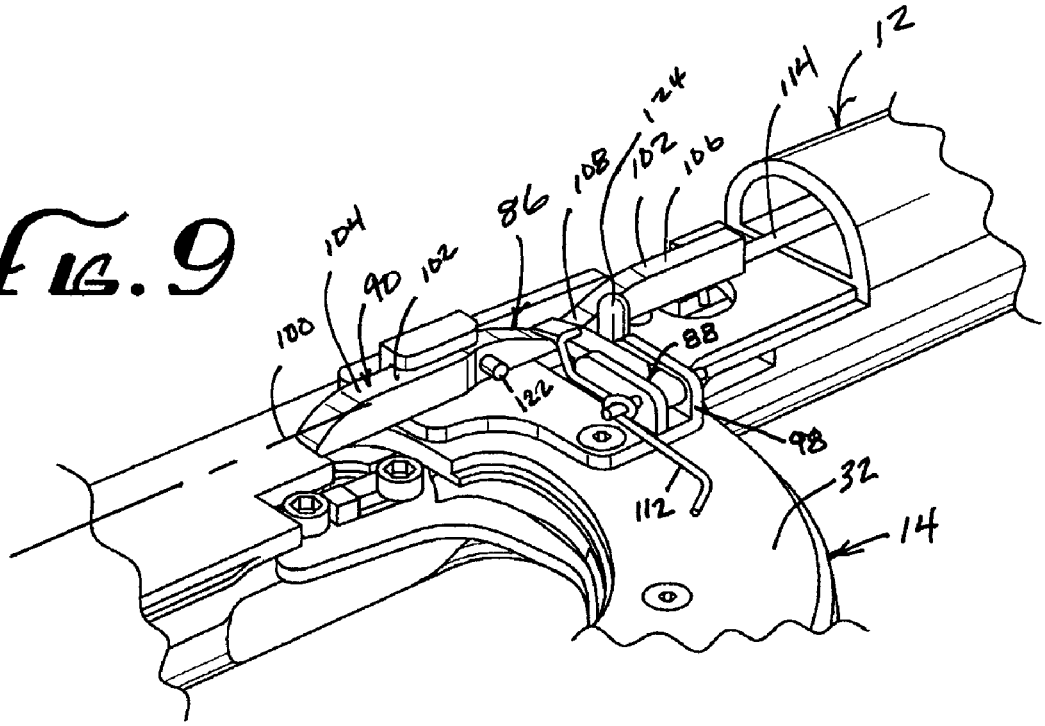
FIG. 9 is a first perspective detail view of a clasp locking mechanism useful in the invention.
Figure 10:
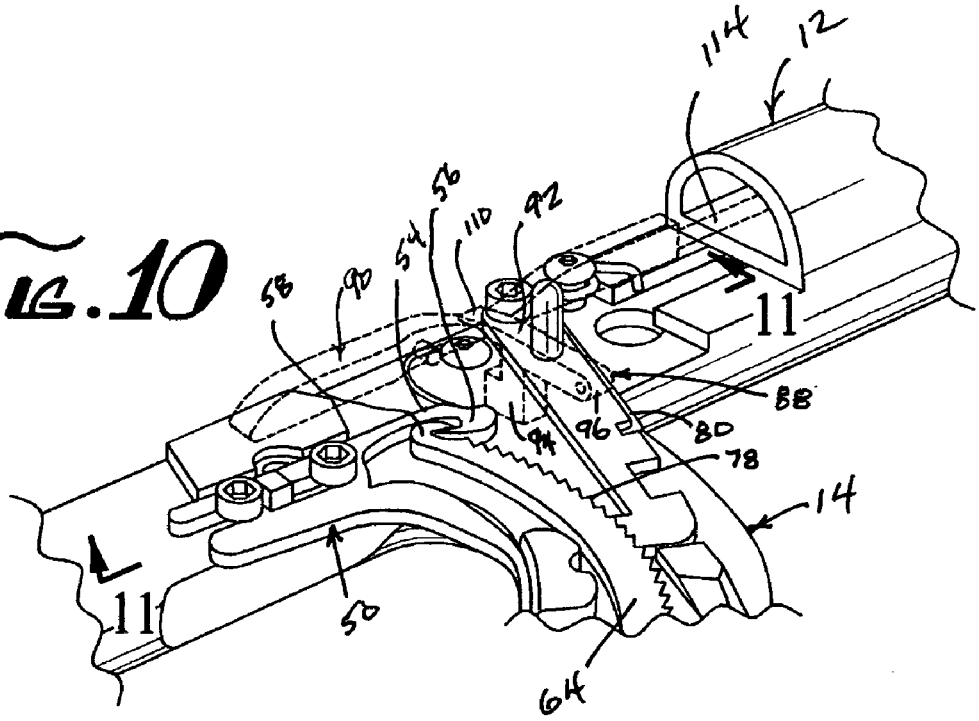
FIG. 10 is a second perspective detail view of a clasp locking mechanism useful in the invention.

The device 10 illustrated in the drawings further comprises a trigger locking mechanism 86 comprising a trigger stop 88 and a cam bar 90. The trigger stop 88 is best seen in FIGS. 10–13. The trigger stop 88 has an upper portion 92 and a lower portion 94. The proximal end 96 of the trigger stop 88 is rotatably affixed in a trigger stop cradle 98 as best seen in FIG. 9. The cam bar 90 is slidably retained along a longitudinal axis 100 parallel to the longitudinal axis 22 of the long member 12. The cam bar 90 comprises an upper surface 102 having a distal ridge 104 and a proximal ridge 106, separated by a central depression 108. The upper portion 92 of the trigger stop 88 at its distal end 110 rides along the upper surface 102 of the cam bar 90. A trigger stop spring 112 biases the trigger stop 88 against the cam block 90.

Figure 11:
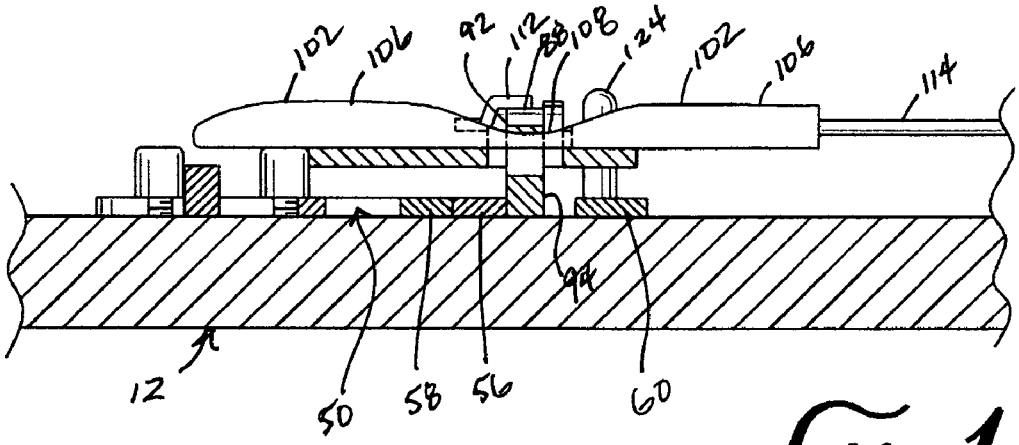
FIG. 11 is a first cross-sectional side detail view of the clasp locking mechanism illustrated in FIG. 9.
Figure 12:
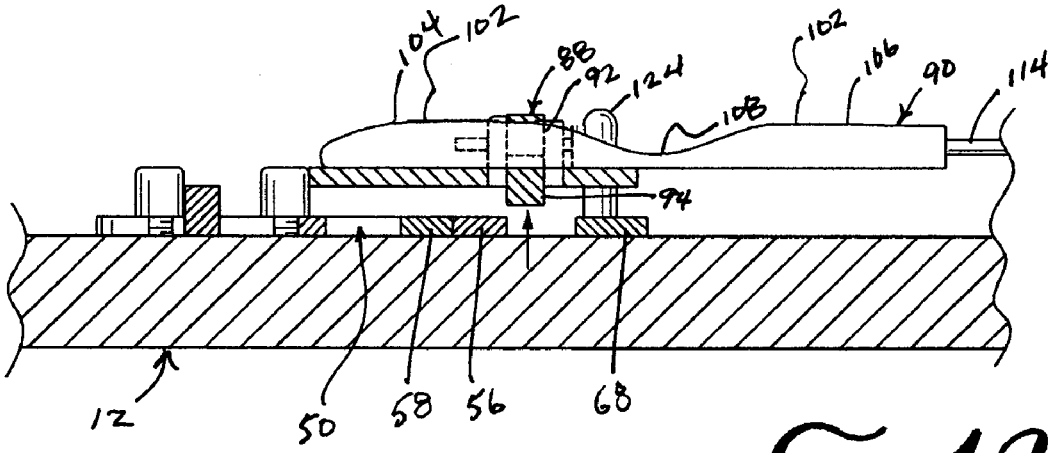
FIG. 12 is a second cross-sectional side detail view of the clasp locking mechanism illustrated in FIG. 9.
Figure 13:
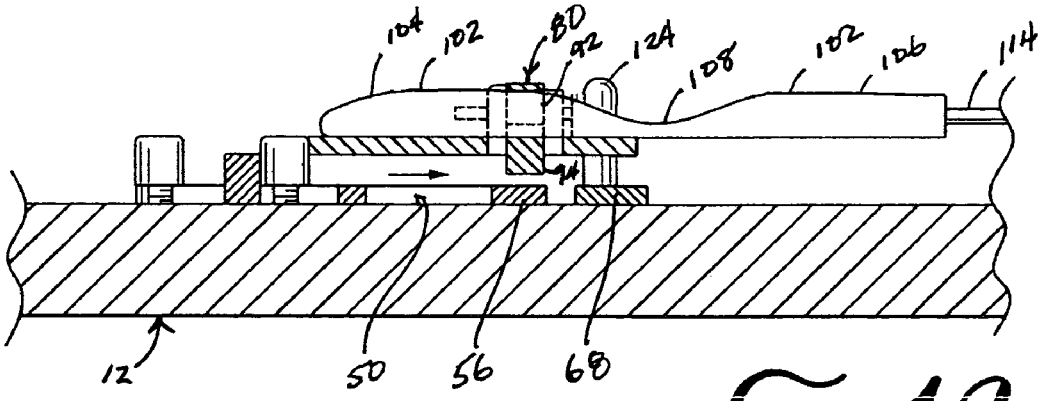
FIG. 13 is a third detail cross-sectional side view of the clasp locking mechanism illustrated in FIG. 9.

As illustrated in FIGS. 11–13, the trigger stop 88 can alternatively be placed (i) in the path of the trigger 50 to prevent the lateral sliding of the trigger 50, and (ii) above the path of the trigger 50 to allow the lateral sliding of the trigger 50. In FIG. 11, the trigger stop 88 is shown disposed within the central depression 108 of the cam bar 90. The lower portion 94 of the trigger stop 88 is thereby disposed at a sufficiently low elevation to block the trigger latch 56 from moving to the right in FIG. 11. By preventing the trigger latch 56 from moving to the right in FIG. 11, the trigger stop 88 prevents the operation of the trigger 50 to activate the power means 40 to rotate the handcuff clasp 16 to the closed position. In FIG. 12, the trigger stop 88 is shown resting upon the distal ridge 104 of the cam block 90. In this position, the trigger stop 88 is raised to a sufficient elevation to allow the lateral movement of the trigger latch 56. Thus, in this position, the trigger latch 56 can be moved to the right in FIG. 13 to allow the trigger latch 56 to release from the latch tip 58 of the clasp extension member 60 to thereby activate the power means 40 to rotate the handcuff clasp 16 to the closed position.

The cam bar 90 is alternatively moved back and forth in a direction parallel with the longitudinal axis 22 of the long member by a settings rod 114 disposed within the proximal end 18 of the long member 12. A rod pin 116 is attached to the settings rod 114 and is retained within a J-shaped groove 118 in the side wall 24 of the long member 12. The rod pin 116 is attached to a settings adjustment collar 120. The settings adjustment collar 120 is both slidable along the long member 12 in a direction parallel with the longitudinal axis 22 of the long member 12 and rotatable about the exterior of the long member 12. By sliding the settings adjustment collar 120 and/or by rotating the settings adjustment collar 120, the rod pin 116 is caused to travel within the J-shaped groove 118.

The settings rod 114, the rod pin 116 and the J-shaped groove 118 cooperate to alternatively move the rod pin 114 between a first position wherein the rod pin 114 is disposed at the top of the long side of the J-shaped groove 118, a second position wherein the rod pin 114 is disposed at the base of the J-shaped groove 118 and a third rod pin position wherein the rod pin 114 is disposed at the top of the short side of the J-shaped groove 118. In the first rod pin position, the cam bar 90 is disposed in its proximal-most position, and the trigger stop 88 is disposed upon the distal ridge 104. In the second rod pin position, the cam block 90 is disposed in its distal-most position, and the trigger stop 88 rests upon the proximal ridge 106. In the third rod pin position, the trigger stop 88 rests within the central depression 108 between the distal ridge 104 and the proximal ridge 106.

In the embodiment illustrated in the drawings, the cam bar 90 further comprises a contacting 122 pin disposed so as to extend laterally from the cam bar 90. The contacting pin 122 is most easily seen in FIG. 9. The size and location of the contacting pin 122 is selected so that the contacting pin 122 engages a release pin 124 attached to the clasp lock 70. The release pin 124 is also best seen in FIG. 9. When the cam bar 90 is moved to its proximal-most position, the contacting pin 122 contacts and engages the release pin 124 and urges the release pin 124 to the right in the drawings. This action urges the clasp lock 70 to the right, whereupon its teeth 76 are disengaged from the teeth 78 on the clasp extension member 60. Once the teeth 76 on the clasp lock 70 are disengaged from the teeth 78 on the clasp extension member 60, the clasp extension member 60 is free to travel in the direction of the trigger latch 56, thereby allowing the retracting of the handcuff clasp 16 from the closed position to the open position.

The device 10 can further comprise many other options not shown in the drawings. For example, a pepper spray container can be disclosed in one of the ends of the long member 16. Also, a flashlight can be built into the device 10. Still further, a taser launcher can be built into the device 10. Still further, a second slot, defined by a pair of members and having a built-in handcuff clasp 16, can be attached to the proximal end 18 of the long member 12. In some embodiments, such additional slot-providing attachment can be adapted to be "snapped on" to the proximal end 18 of the long member 12.

In operation as a nightstick, the handcuff clasp 16 is placed in the retracted, open position by manipulating the settings adjustment collar 120 to place the rod pin 116 in the first rod pin position, at the top of the long side of the J-shaped groove 118. By this action, the contacting pin 122 is caused to engage the release pin 124, urging the clasp lock 70 to disengage from the clasp extension member 60. The clasp extension member 60 is thereby free to travel towards the trigger latch 56. Once the clasp latch is disengaged from the clasp extension member 60, the peace officer manually retracts the handcuff clasp 16 back into the short member 14. As the peace officer does this, the clasp extension member 60 is caused to travel to the trigger latch 56 where the latch tip 58 at the end of the clasp extension member 60 is caused to engage the trigger clasp by the trigger stop spring 112, thereby firmly retaining the handcuff clasp 16 in the open position. The peace officer then manipulates the settings adjustment collar 120 to move the rod pin 116 to the second rod pin position at the base of the J-shaped groove 118. When the rod pin 116 is in the second rod pin position, the trigger stop 88 is disposed within the central depression 108 of the cam block, thereby blocking the movement of the trigger 50. In this position, the trigger 50 is deactivated and the handcuff clasp 16 cannot be inadvertently closed. When the peace officer prepares to make an arrest, the peace officer moves the rod pin 116 to the third rod pin position, wherein the rod pin 116 is disposed at the top of the short side of the J-shaped groove 118. By this step, the device 10 is now action-ready. When the peace officer desires to make an arrest, the peace officer grasps the proximal end of the long member 12 and thrusts the distal end of the device 10 in such a way that the slot 26 surrounds the wrist, arm, ankle or leg of the potential arrestee. Then the device 10 is further thrusted, so that the surrounded portion of the arrestee's anatomy is moved into contact with the trigger 50, whereupon the trigger 50 is caused to move in a direction towards the proximal end 18 of the long member 12. When this occurs, the trigger latch 56 is disengaged from the latch tip 58 of the latch extension member 60 and the handcuff clasp 16 is free to travel from the open position to the closed position. The power means 40 are thereby activated to rapidly move the handcuff clasp 16 to the closed position before the potential arrestee can retract himself or herself from the slot 26. Once the handcuff clasp 16 is moved to the closed position, the clasp lock 70 firmly retains the clasp extension member 60, thereby firmly locking the handcuff clasp 16 in the closed position. The peace officer can then readily subdue the arrestee without having to come into close proximity to the arrestee.

When the device 10 is used as a nightstick, it provides the peace officer with a myriad of advantages heretofore not available to the peace officer. The device 10 allows the peace officer to capture and firmly retain an arrestee without having to come into close proximity to the arrestee. This greatly minimizes danger to the peace officer during the arrest-making process. By use of the device 10 as a nightstick, the arrestee is firmly captured by the peace officer at a distance too far away from the peace officer to allow the arrestee to punch at the peace officer or grapple for the peace officer's revolver.

Also, once the device 10 is attached to the arrestee, the arrestee is inhibited in his or her ability to escape, even if the device 10 slips out of the hands of the peace officer. This is because the unlocking of the handcuff clasp 16 is not readily accomplished and any flight attempt while attached to the relatively heavy and awkward nightstick device 10 is all but prohibited.

Moreover, use of the device 10 by the peace officer allows the peace officer to retain and subdue an arrestee with minimal notice to the arrestee. Without the device 10 of the invention, once a peace officer intends to make an arrest, he or she must reach for his or her handcuffs. Once he or she does so, the potential arrestee is put on notice of his or her imminent arrest and can become combative or attempt to flee. By using the device 10 of the invention, the potential arrestee has little or no notice of his or her impending arrest. The peace officer need only thrust the nightstick against the arrestee's wrist and instantly retain custody of the arrestee.

Once an arrestee is retained within the enclosed portion of the slot 26, it is very easy for the peace officer, even a peace officer of under average strength, to maintain control of the arrestee. This is simply and easily accomplished by the twisting of the proximal end of the long member 12. Such twisting applies pressure and resulting pain to the captured wrist of the arrestee. The peace officer can quickly and easily force the arrestee to the ground where the arrestee can thereafter be traditionally handcuffed with greatly reduced risk to the peace officer.

Contrary to procedures made necessary by the prior art, use of the device 10 minimizes the need for the peace officer to threaten to shoot a belligerent arrestee or to have to beat a belligerent arrestee into submission.

In certain situations, the device 10 can be wielded as a club while the peace officer firmly grips the distal end 20 of the long member 12. In such situations, the short member 14 acts as a hand protector for the peace officer.

Finally, in embodiments wherein the short member 14 comprises an arcuate section 30, there is reduced danger over nightsticks of the prior art of the short member 14 becoming caught on the peace officer's uniform when the peace officer carries the device 10 under his or her arm.

Although the device 10 can be used very effectively as a nightstick, many other uses for the device 10 also exist. For example, the device 10 can be used to safely capture and subdue wild animals. The device 10 can also be used to reach and clasp to inanimate objects, similar to the use of a grappling hook. For such uses, the long member 12 can be made considerably longer than when the device 10 is to be used as a nightstick.

Having thus described the invention, it should be apparent that numerous structural modifications and adaptations may be resorted to without departing from the scope and fair meaning of the instant invention as set forth hereinabove and as described hereinbelow by the claims.

What is claimed is:

1. A device useful as a nightstick comprising:

(a) a long member, the long member being generally linear and having a proximal end, a distal end and one or more side walls;

(b) a short member attached to the long member near the distal end of the long member, the short member and the long member cooperating to define a slot with a single open end, the slot being at least about 2 inches in length;

(c) a power-operated handcuff clasp for closing the open end of the slot to thereby define an enclosed portion of the slot having a maximum length of between about 1½ inches and about 6 inches and a maximum width of between about 1½ inches and about 6 inches, the handcuff clasp being moveable between a closed position and an open position;

(d) power means for urging the handcuff clasp to the closed position; and (e) a trigger disposed proximate to the proximal end of the short member for activating the power means and to thereby cause the handcuff clasp to rapidly move from the open position to the closed position.

2. The device of claim 1 wherein the slot is between about 1½ inches and about 4 inches in length.

3. The device of claim 1 wherein the enclosed portion of the slot has a maximum length between about 1½inches and about 2 inches and has a maximum width between about 1½ inches and 2 inches.

4. The device of claim 1 wherein the long member and the short member are made of steel.

5. The device of claim 1 wherein the power means comprises one or more springs.

6. The device of claim 1 wherein the length of the long member is at least 1½ foot long.

7. The device of claim 1 wherein the long member has a length between about 1½ feet and about 2½ feet.

8. The device of claim 1 wherein the short member comprises an arcuate section.

9. The device of claim 1 wherein the open end of the slot is wider than an end opposite the open end.

10. The device of claim 1 further comprising a clasp locking mechanism.

11. The device of claim 10 wherein the clasp locking mechanism comprises a clasp extension member and a clasp lock, the clasp lock being capable of engaging and retaining the clasp extension member.

12. The device of claim 11 wherein both the clasp extension member and the clasp lock comprise a plurality of teeth capable of engaging and retaining one another.

13. The device of claim 1 further comprising a trigger locking mechanism.

14. The device of claim 13 wherein the trigger locking mechanism comprises a trigger stop and a cam bar having an upper edge, the trigger stop riding along the upper edge of the cam bar.

15. The device of claim 14 wherein the cam bar is manipulated by a settings rod, the settings rod having a rod pin retained in a groove within the one or more side walls of the long member.

16. The device of claim 15 wherein the movement of the rod pin within the groove in the one or more side walls of the long member alternatively causes the trigger stop to (i) block the movement of the trigger and to (ii) retract away from the path of the trigger so as to not block the path for the movement of the trigger.

17. The device of claim 15 wherein the groove within the one or more side walls of the long member is J-shaped.

18. The device of claim 1 wherein the handcuff clasp, when in the closed position, is fully disposed within the slot.

* * * * *